US007001175B2

(12) United States Patent
Yang

(10) Patent No.: US 7,001,175 B2
(45) Date of Patent: Feb. 21, 2006

(54) UTILITY LIGHTER WITH SAFETY ARRANGEMENT

(76) Inventor: John Jiin Chung Yang, 15443 Proctor Ave., Suite B, Industry, CA (US) 91745

( * ) Notice: Subject to any disclaimer, the term of this patent is extended or adjusted under 35 U.S.C. 154(b) by 0 days.

(21) Appl. No.: 10/672,667

(22) Filed: Sep. 26, 2003

(65) Prior Publication Data

US 2004/0063055 A1 Apr. 1, 2004

Related U.S. Application Data

(63) Continuation-in-part of application No. 10/038,087, filed on Jan. 3, 2002, now abandoned.

(51) Int. Cl.
*F23D 11/36* (2006.01)

(52) U.S. Cl. ..... 431/153; 431/255

(58) Field of Classification Search ..... 431/153, 431/255

See application file for complete search history.

(56) References Cited

U.S. PATENT DOCUMENTS

| | | | | | |
|---|---|---|---|---|---|
| 4,778,380 | A | * | 10/1988 | Nitta | 431/255 |
| 4,830,603 | A | * | 5/1989 | Cirami | 431/153 |
| 5,326,256 | A | * | 7/1994 | Shike et al. | 431/255 |
| 5,368,473 | A | * | 11/1994 | Kenjiro et al. | 431/153 |
| 5,407,346 | A | * | 4/1995 | Sher | 431/153 |
| 5,409,372 | A | * | 4/1995 | Nobuo | 431/153 |
| 5,417,563 | A | * | 5/1995 | Cirami | 431/153 |
| 5,421,720 | A | * | 6/1995 | Sher | 431/153 |
| 5,437,549 | A | * | 8/1995 | Saito | 431/153 |
| 5,645,414 | A | * | 7/1997 | Wang | 431/153 |
| 5,865,614 | A | * | 2/1999 | Hsu | 431/255 |
| 6,077,069 | A | * | 6/2000 | Fairbanks et al. | 431/153 |
| 6,086,358 | A | * | 7/2000 | Potskhishvili et al. | 431/153 |
| 6,093,017 | A | * | 7/2000 | Saito et al. | 431/153 |
| 6,126,437 | A | * | 10/2000 | Lixiang et al. | 431/153 |
| 6,129,543 | A | * | 10/2000 | Potskhishvili et al. | 431/153 |
| 6,135,762 | A | * | 10/2000 | Hu | 431/153 |
| 6,244,858 | B1 | * | 6/2001 | Wang | 431/153 |
| 6,325,617 | B1 | * | 12/2001 | Sung | 431/153 |
| 6,468,070 | B1 | * | 10/2002 | Jon | 431/153 |
| 6,488,493 | B1 | * | 12/2002 | Sung | 431/153 |
| 2001/0023054 | A1 | * | 9/2001 | Sung | 431/153 |
| 2001/0041315 | A1 | * | 11/2001 | Sung | 431/153 |
| 2002/0064744 | A1 | * | 5/2002 | Tse | 431/344 |

FOREIGN PATENT DOCUMENTS

| | | | |
|---|---|---|---|
| JP | 0618030 | * | 1/1994 |
| WO | WO 99/47855 | * | 9/1999 |

* cited by examiner

*Primary Examiner*—Carl D. Price
(74) *Attorney, Agent, or Firm*—Raymond Y. Chang; David & Raymond

(57) ABSTRACT

A safety arrangement for a utility lighter includes a stop post extended from a pusher button and a locking member which includes a switching member slidably mounted on a sidewall of the casing along a safety slot and a stopper extended from the switching member to the internal cavity through the safety slot to align with the stop post. The switching member is arranged to slidably drive the stopper between a locked position and an unlocked position, wherein at the locked position, the stop post is blocked by the stopper so as to block a downward movement of the pusher button for ignition, and at the unlocked position, the switch member is arranged to drive the stopper to move to an offset position that allows the pusher button to be depressed so as to depress the movable part of the piezoelectric unit for igniting the utility lighter.

4 Claims, 12 Drawing Sheets

UTILITY LIGHTER WITH SAFETY ARRANGEMENT

CROSS REFERENCE OF RELATED APPLICATION

This is a Continuation-In-Part application of a non-provisional application having an application Ser. No. 10/038,087 and filing date of Jan. 03, 2002 now abandoned.

BACKGROUND OF THE PRESENT INVENTION

1. Field of Invention

The present invention relates to a utility lighter, and more particularly to a utility lighter incorporated with a safety arrangement that prevents the lighter from accidentally or undesirably ignited.

2. Description of Related Arts

Conventional lighters have been widely used all over the world. However, these conventional lighters can be operated easily and conveniently that even children can ignite a light by using the conventional lighters without any difficulty. In such circumstances, it is extremely dangerous that a young child by chance gets a conventional lighter at hands but no other adults notice him/her. The child may ignite the lighter due to his/her curiosity and may eventually get burnt. In worse, a fire may even be caused.

Most accidental fire cases today, many were started by the ignorant usage of the lighter, especially a barbecue lighter used at home such as pilot light for stoves outdoor activities such as fireplaces or camping. Those accidental fires are caused by ignorance of human mistakes, especially young children. So, nowadays, both U.S. government and U.S. Consumer Product Safety Commission demand a safety device in every lighter including the barbecue lighter to prevent any unwanted ignition accidentally or by a child.

Therefore, a kind of locking switch incorporated with convention lighters has been developed to prevent the lighter from being accidentally ignited. That kind of locking switch allows a user of the lighter to selectively switch it in a locked state or an unlocked state. The user can only ignite the lighter when it is in the unlocked stated. Superficially, the locking switch is good in that it allows the user to lock the lighter and thus children are no longer able to ignite it unattended. However, such conventional locking switch is incapable of automatically locking the lighter after use. Therefore, if a user forgets to re-switch to lock the lighter after use, a child can still be able to ignite the lighter and generate light.

SUMMARY OF THE PRESENT INVENTION

A main object of the present invention is to provide a utility lighter incorporated with a safety arrangement, which is capable of automatically locking the lighter of the present invention from being accidentally ignited when it is idle or not in use.

Another object of the present invention is to provide a utility lighter incorporated with a safety arrangement, which can only be ignited by unlocking the safety arrangement of the lighter.

Another object of the present invention is to provide a utility lighter incorporated with a safety arrangement, which can only be ignited by two simultaneous actions of a user, i.e. an action of unlocking the safety arrangement and an action of igniting the lighter.

Another object of the present invention is to provide a utility lighter incorporated with a safety arrangement, which comprises gas releasing unit for control a flow of liquefied fuel when the pusher button is downwardly depressed so as to prevent the failure of the ignition operation of the utility lighter.

Another object of the present invention is to provide a utility lighter incorporated with a safety arrangement, which does not significantly alter the original structure and shape of conventional lighter, so as to minimize the manufacturing cost of the lighter of the present invention.

Accordingly, in order to accomplish the above objects, the present invention provides a utility lighter, comprising:

a casing having a lighter housing, which has an internal cavity and a pusher cavity therein, and a tubular lighter rod extended from the lighter housing, wherein the lighter housing further has a safety slot communicating the internal cavity with an exterior of the lighter housing;

a fuel storage housing disposed in the internal cavity of the lighter housing for storing liquefied gaseous fuel;

an ignition system which comprises:

a gas emitting nozzle communicated with the fuel storage housing for releasing gaseous fuel;

a gas tube extended from the gas emitting nozzle to a top end portion of the lighter rod to form an ignition tip therein;

a piezoelectric unit supported in the internal cavity for generating piezoelectricity, wherein the piezoelectric unit comprises a movable part and a spark generating tip extended to the ignition tip through the lighter rod for generating sparks when the movable part of the piezoelectric unit is depressed; and a pusher button which is supported in the pusher cavity in a slidably movable manner to drive the movable part of the piezoelectric unit to be depressed; and a safety arrangement, which comprises:

a stop post extended from the pusher button;

a locking member, which comprises a switching member slidably mounted on an outer wall of the casing along the safety slot and a stopper extended from the switching member to the internal cavity through the safety slot to align with the stop post, wherein the switching member is arranged to slidably drive the stopper between a locked position and an unlocked position, wherein at the locked position, the stop post is blocked by the stopper so as to block a downward movement of the pusher button for ignition, and at the unlocked position, the switch member is arranged to drive the stopper to move to an offset position that allows the pusher button to be depressed so as to depress the movable part of the piezoelectric unit for igniting the utility lighter; and a resilient element supported in the internal cavity of the lighter housing for urging a pushing force to the locking member to normally retain the locking member at the locked position.

These and other objectives, features, and advantages of the present invention will become apparent from the following detailed description, the accompanying drawings, and the appended claims.

DETAILED DESCRIPTION OF THE PREFERRED EMBODIMENTS

Figure 1:
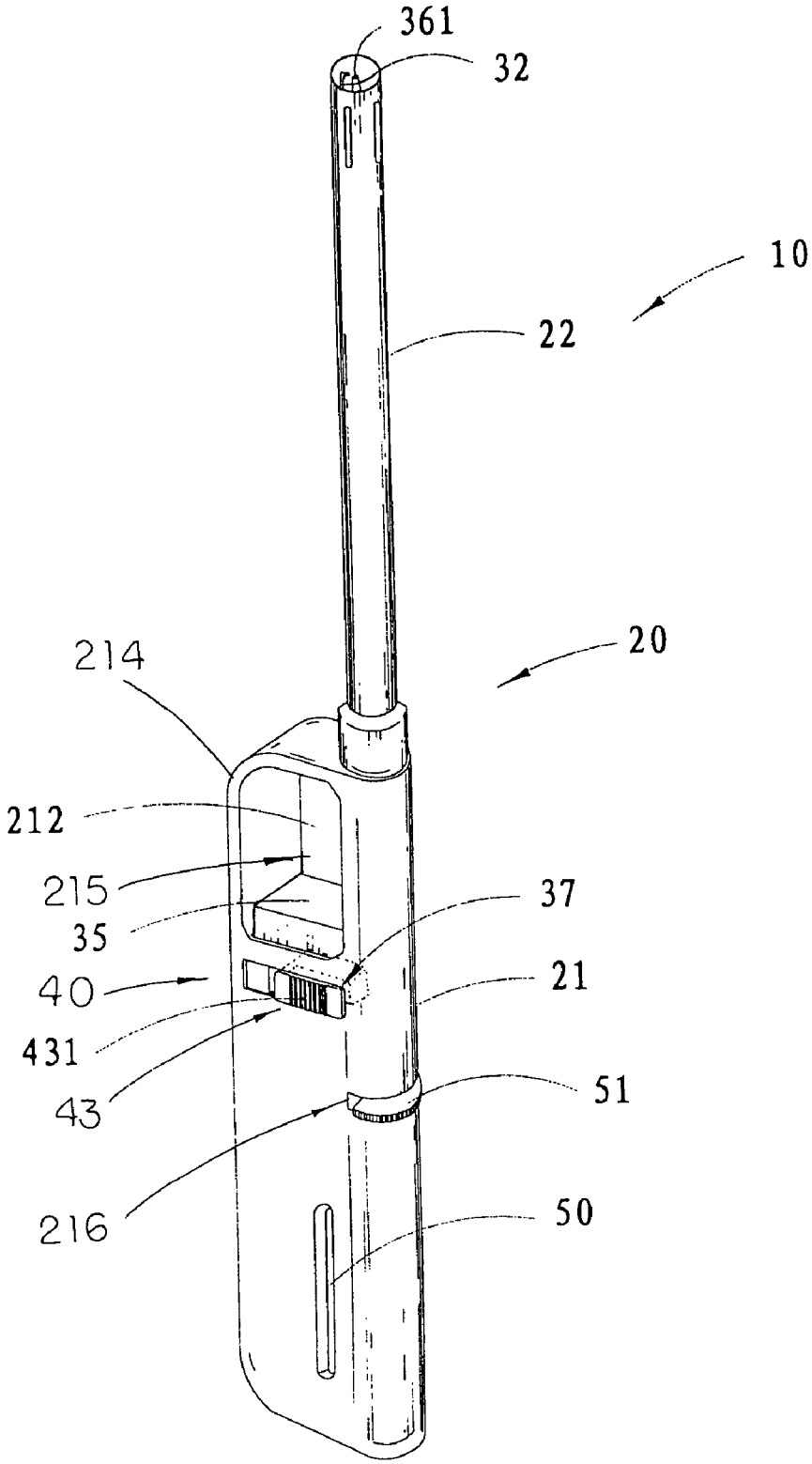
FIG. 1 is a perspective view of a utility lighter incorporated with a safety arrangement according to a first preferred embodiment of the present invention.
Figure 2:
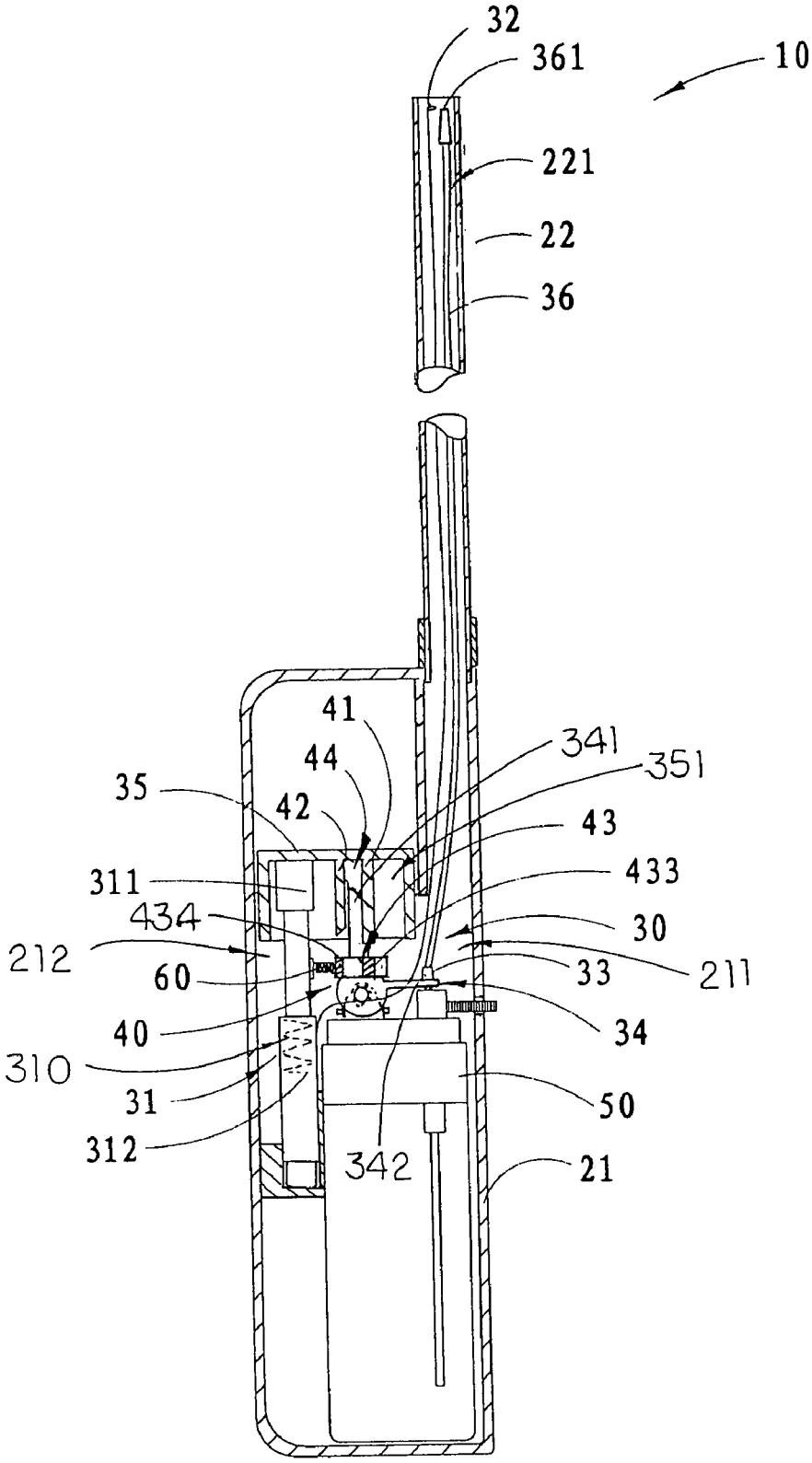
FIG. 2 is a sectional schematic view illustrating the internal structure of the utility lighter according to the above first preferred embodiment of the present invention.

Referring to FIGS. 1 and 2 of the drawings, a utility lighter 10 according to a preferred embodiment of the present invention is illustrated, wherein the utility lighter 10, such as a conventional barbecue lighter, comprises a casing 20 which comprises a lighter housing 21 and a tubular lighter rod 22 upwardly extended from the lighter housing 21, an ignition system 30 supported in the casing 20, and a safety arrangement 40 supported by the casing 20 for locking up the ignition of the utility lighter 10 so as to prevent the utility lighter 10 from being ignited.

As shown in FIG. 2, the lighter housing 21 has an internal cavity 211 therein to receive the ignition system 30 and the lighter rod 22 has a transmitting cavity 221 to communicate with the internal cavity 211. The utility lighter 10 further comprises a fuel storage housing 50 disposed in the internal cavity 211 of the lighter housing 21 for storing liquefied gaseous fuel to communicate with the ignition system 30 for igniting a light from the utility lighter 10. The lighter housing 21 further has a safety slot 37 communicating the internal cavity 211 with an exterior of the lighter housing 21, and a pusher cavity 212 communicated with the internal cavity 211.

As shown in FIGS. 1 and 2, the ignition system 30 a piezoelectric unit 31 for generating piezoelectric, a spark generating tip 32 extended from the piezoelectric unit 31 for generating spark, a gas emitting nozzle 33 which is communicated with the fuel storage housing 50 and adapted to release gaseous fuel when it is uplifted by a gas lever 34, and a pusher button 35 operatively attached to the piezoelectric unit 31 as well as the gas emitting nozzle 33 through the gas lever 34. The ignition system 30 further comprises a gas tube 36 extended from the gas emitting nozzle 33 to a top end of the lighter rod 22 to form an ignition tip 361 therein. The liquefied fuel which is released through the gas emitting nozzle 33 is transmitted via the gas tube 36 to the ignition tip 361 where the liquefied fuel is finally emitted to the atmosphere.

The piezoelectric unit 31, which is supported in the internal cavity 211 for generating piezoelectricity, comprises a movable part 311, wherein spark generating tip 32 extended to the ignition tip 361 through the lighter rod 22 for generating sparks when the movable part 311 of the piezoelectric unit 31 is depressed.

The pusher button 35 is supported in the pusher cavity 212 in a slidably movable manner to drive the movable part 311 of the piezoelectric unit 31 to be depressed.

When the pusher button 35 is depressed downwardly, the movable part 311 of the piezoelectric unit 31 is then depressed downwardly by the pusher button 35. When the movable part 311 is depressed to the ignition point of the piezoelectric unit 31, sparks are generated at the spark generating tip 32. At the same time, the pusher button 35 depresses a depressing end 341 of the gas lever 34 downwardly and therefore uplifts the uplifting end 342 of the gas lever 34 so as to lift up the gas emitting nozzle 33 for releasing liquefied fuel to the gas tube 36 which then releases the liquefied fuel outside the utility lighter 10 through the ignition tip 361. The spark generating tip 32 is extended from the fixed part 312 of the piezoelectric unit 31 to a position next to the ignition tip 361 in the lighter rod 22 of the casing 20. The gas released through the ignition tip 361 is then ignited by the sparks generated at the spark generating tip 32.

Figure 3A:
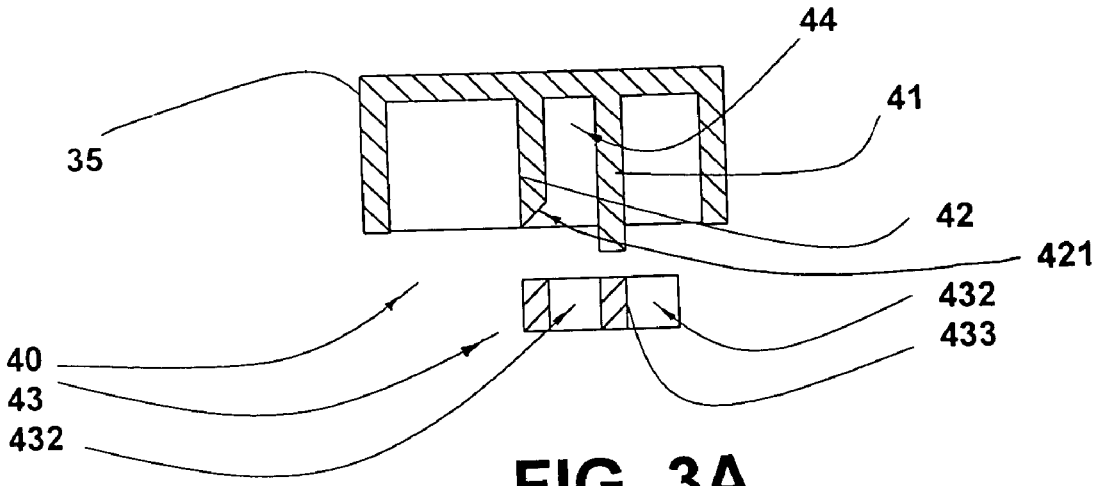
FIGS. 3A to 3F are partially sectional schematic views illustrating the safety arrangement of the utility lighter according to the above first preferred embodiment of the present invention, in which the utility lighter of the present invention is operated from a locked position to an unlocked position for ignition.
Figure 3B:
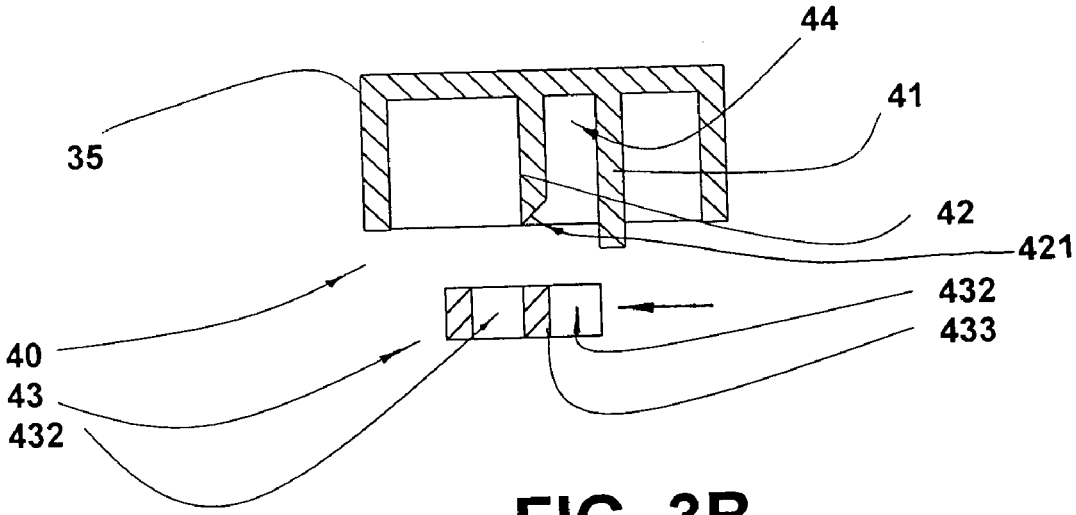

Referring to FIGS. 3A and 3B of the drawings, the pusher button 35 has a locking cavity 351 provided therein for receiving the safety arrangement 40 of the utility lighter 10. The safety arrangement 40 comprises a stop post 41 and a guider latch 42, wherein are integrally and downwardly projected from a top wall of the pusher button 35 and extended vertically and spacedly inside the locking cavity 351 of the pusher button 35 so as to define a guiding slot 44 therebetween.

As shown in FIGS. 1 and 2, the safety arrangement 40 further comprises a locking member 43 supported by the lighter housing 21 and positioned right below the pusher button 35. The locking member 43 comprises an outer switching member 431 extended outside the lighter housing 21 through a safety slot 37 and a stopper 433 slidably supported inside the lighter housing 21, wherein the stopper 433 is connected to the switching member 431 by a driver member 434. The switching member 431 is adapted for being switched, as shown in FIG. 1, by means of sliding along the safety slot 37, between a locked position and an unlocked position of the safety slot 37, and the stopper 433 is capable of being driven by the switching member 431 through the driver member 434 to move between the locked position and the unlocked position, wherein the stopper 433 is arranged to bias against the stop post 41 when the locking member 43 is in the locked position, as shown in FIG. 2.

The utility lighter 10 further comprises a resilient element 60 securely mounted in the lighter housing 21 and adapted for applying an urging force to the locking member 43 to push the locking member 43 to the locked position. On the other hand, the piezoelectric unit 31 comprises a resilient unit 310 therein for applying an upward pressure on its movable part 311 so that the movable part 311 is normally retained undepressed.

In the locked position, as shown in FIGS. 3A to 3F, the stopper 433 is just aligned with the stop post 41 of the pusher button 35. Note that the safety slot 37 is formed in a sidewall of the lighter housing 21 so as shown in FIG. 1 of the drawings. According to the first embodiment of the present invention, the outer switching member 341 is integrally extended from the stopper 433 of the locking member 43. Also the locking member 43 further has two sliding cavities 432 formed at two sides of the stopper 433 for the guider latch 42 and the stop post 41 to be slid therein respectively.

When the locking member 43 is in normal locked position and when a user tries to depress the pusher button 35, as shown in FIGS. 2 and 3A, the stop post 41 will bias against the stopper 433, and therefore restricts the pusher button 35 from further moving downwardly. In other words, the stop post 41 is positioned right above the stopper 433 of the locking member 43, so that the downward movement of the pusher button 35 is blocked and locked by the locking member 43. Therefore, the pusher button 35 cannot depress the piezoelectric unit 31 to generate a spark at the spark generating tip 32. Also, the depressing end 341 of the gas lever 34 is not significantly depressed to uplift its uplifting end 342 thereof due to the blocking of downward motion of the pusher button 35 by the stopper 433. As a result, the gas emitting nozzle 33 does not emit the liquefied fuel required to ignite the utility 10. Whereby, the utility lighter 10 cannot be ignited and the utility lighter 10 is locked.

Referring to FIGS. 1 to 3, to unlock the utility lighter 10, the user must switch the switching member 431 along the safety slot 37 to the unlocked position, wherein the locking member 43 is pushed aside until the stopper 433 moves from right below the stop post 41 to right below the guiding latch 42 of the pusher button 35, as shown in FIG. 3B.

Figure 3C:
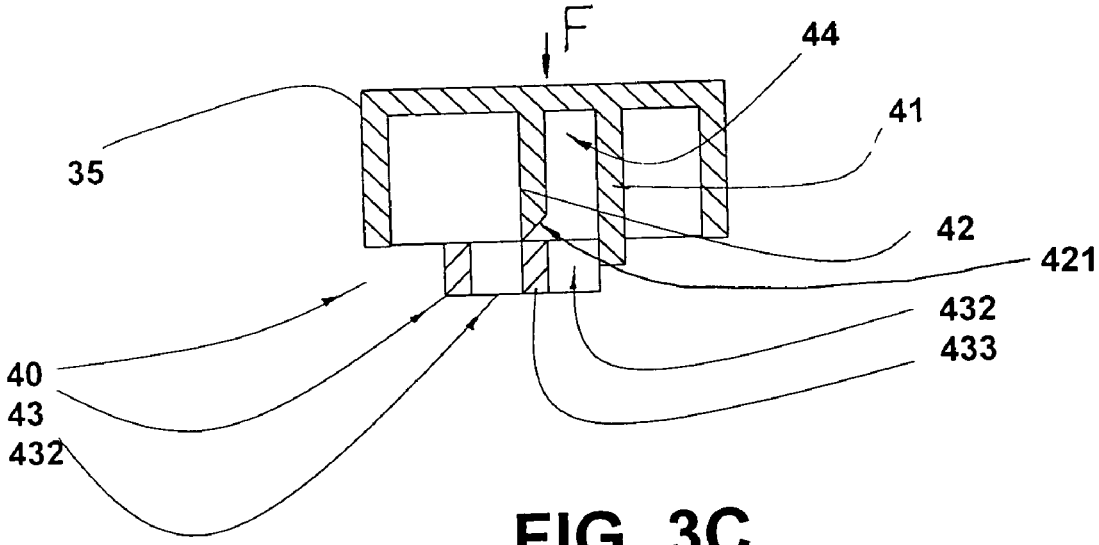
Figure 3D:
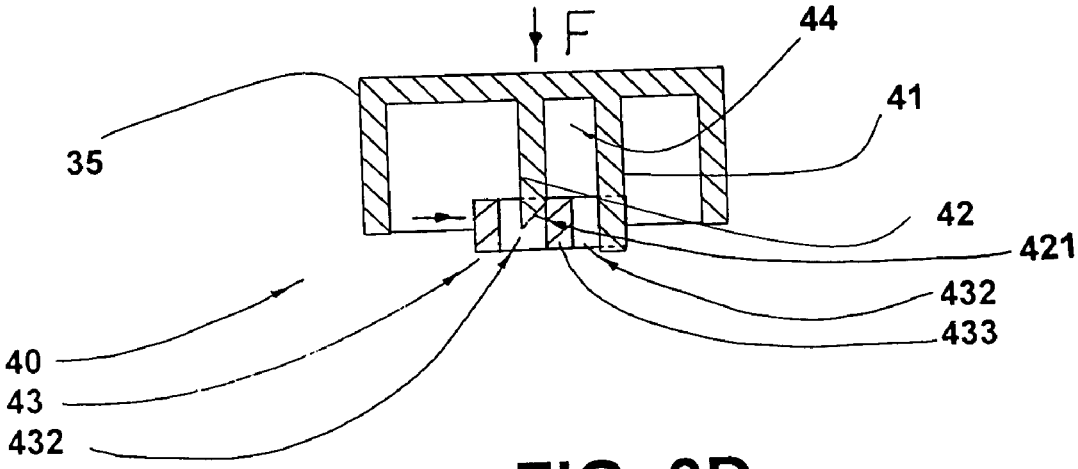
Figure 3E:
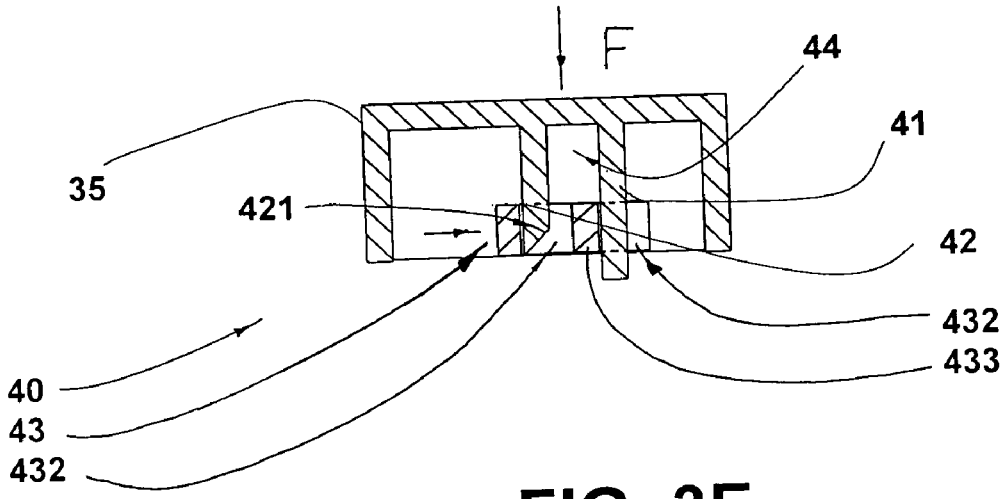
Figure 3F:
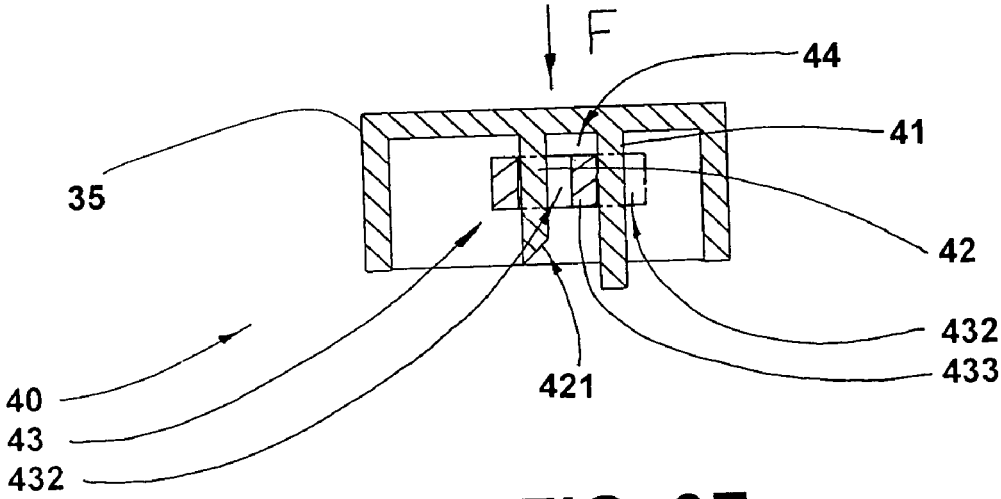

The guider latch 42 has a tapered guiding end having a slanted surface 421 inclined towards the stop post 41 and adapted for biasing against a top end of the stopper 433. At the unlocked position, the user is free to depress the pusher button 35 to ignite the utility lighter 10. When the locking member 43 is in the unlocked position and the pusher button 35 is depressed downwardly by a depressing force F, the slanted surface 421 of the guiding latch 42 will bias against the top end of the stopper 433, as shown in FIG. 3C. The slanted surface 421 of the tapered guiding end of the guider latch 42 enables the pusher button 35 to be further depressed that causes the locking member 43 to move backward to its original locked position and, at the same time, drives the guider latch 42 to move downwardly, as shown in FIG. 3D, until the stopper 433 is inserted into the guiding slot 44. In other words, a user can now be able to freely depress the pusher button 35 to ignite the utility lighter 10 without any blocking from the locking member 43. Note that the above-mentioned backward movement of the locking member 43 will be limited and blocked by the stop post 41, as shown in FIGS. 3E and 3F.

In addition to the resilient element 60 and the resilient unit 310 provided inside the piezoelectric unit 31, the fact that the pusher button 35 is operatively connected to the movable part 311 of the piezoelectric unit 31.

Therefore, once the user has ignited the utility lighter 10, he/she can just simply relief the pusher button 35 and the locking member 43, and then the utility lighter 10 automatically returns to its locked condition in which the pusher button 35 and the locking member 43 are rebounded back to their original positions respectively by the urging forces of the resilient element 60 and the piezoelectric unit 31 respectively. That is, the piezoelectric unit 31 will rebound the pusher button 35 upwards from the ignition position as shown in FIG. 3F to the locked position as shown in FIG. 3A and the resilient element 60 will rebound the locking member 43 to move from the unlocked position as shown in FIGS. 3E and 3F back to its locked position as shown in FIG. 3A.

Referring to FIG. 1 of the drawings, the casing 10 further has a finger guide 214 extended around the pusher button 35 so as to define a finger loop 215 for fittedly receiving a user's finger therein to press the pusher button 35 comfortably. In addition, the fuel storage housing 50 further comprises a flame regulator 51 for adjusting the average flow rate of the liquefied fuel coming out from the fuel storage housing 50 through the gas emitting nozzle 33. The flame regular 51 has a control portion extended outside the lighter housing 21 through a regulator slot 216. Whereby, a user is able to regulate the flow rate of liquefied fuel by adjusting the flame regulator 51, so as to regulate the magnitude of the light ignited.

To ignite the utility lighter 10, the user must unlock the utility lighter 10 first by pushing the outer switching member 431 of the locking member 43 along the safety slot 37 form the locked position to the unlocked position. While the utility lighter 10 is maintained at the unlocked position, the pusher button 35 is ready for being depressed downwardly so as to depress the movable part 311 of the piezoelectric unit 31 to generate sparks at the spark generating tip 32 at the top end portion of the lighter rod 22. At the same time, when the pusher button 35 is being depressed, the pusher button 35 uplifts the gas emitting nozzle 33 via the gas lever 34, and therefore liquefied fuel is released at the ignition tip 361.

After the ignition, the locking member 43 is rebounded back by the resilient element 60 and the pusher button 35 is rebounded by the piezoelectric unit 31 so that, eventually, the utility lighter 10 automatically returns to its normal locked stated. According to the preferred embodiment of the present invention, the resilient element 60 is a regular compressive spring.

Figure 4:
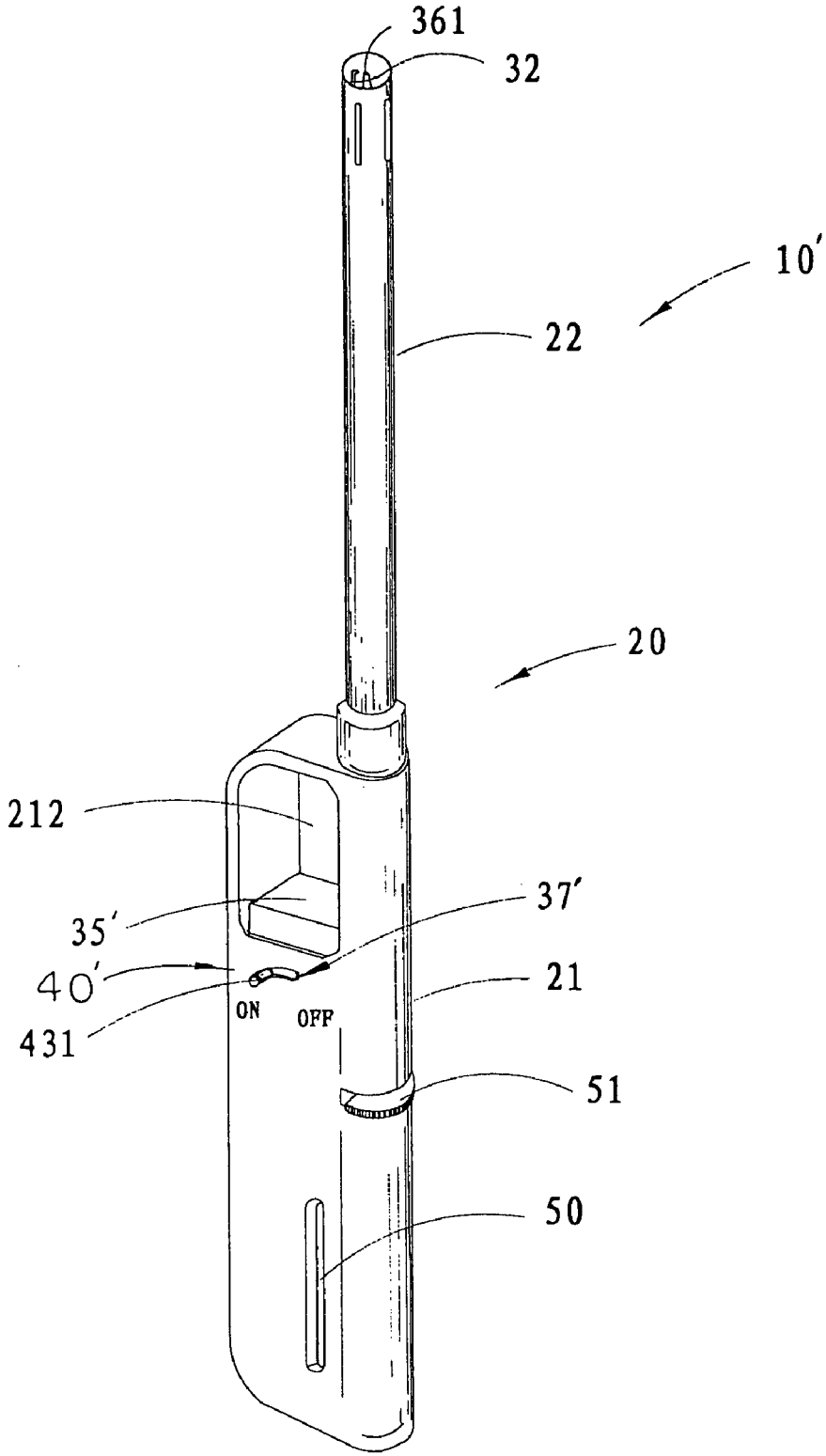
FIG. 4 is a perspective view of the utility lighter incorporated with a safety arrangement according to a second preferred embodiment of the present invention.
Figure 5:
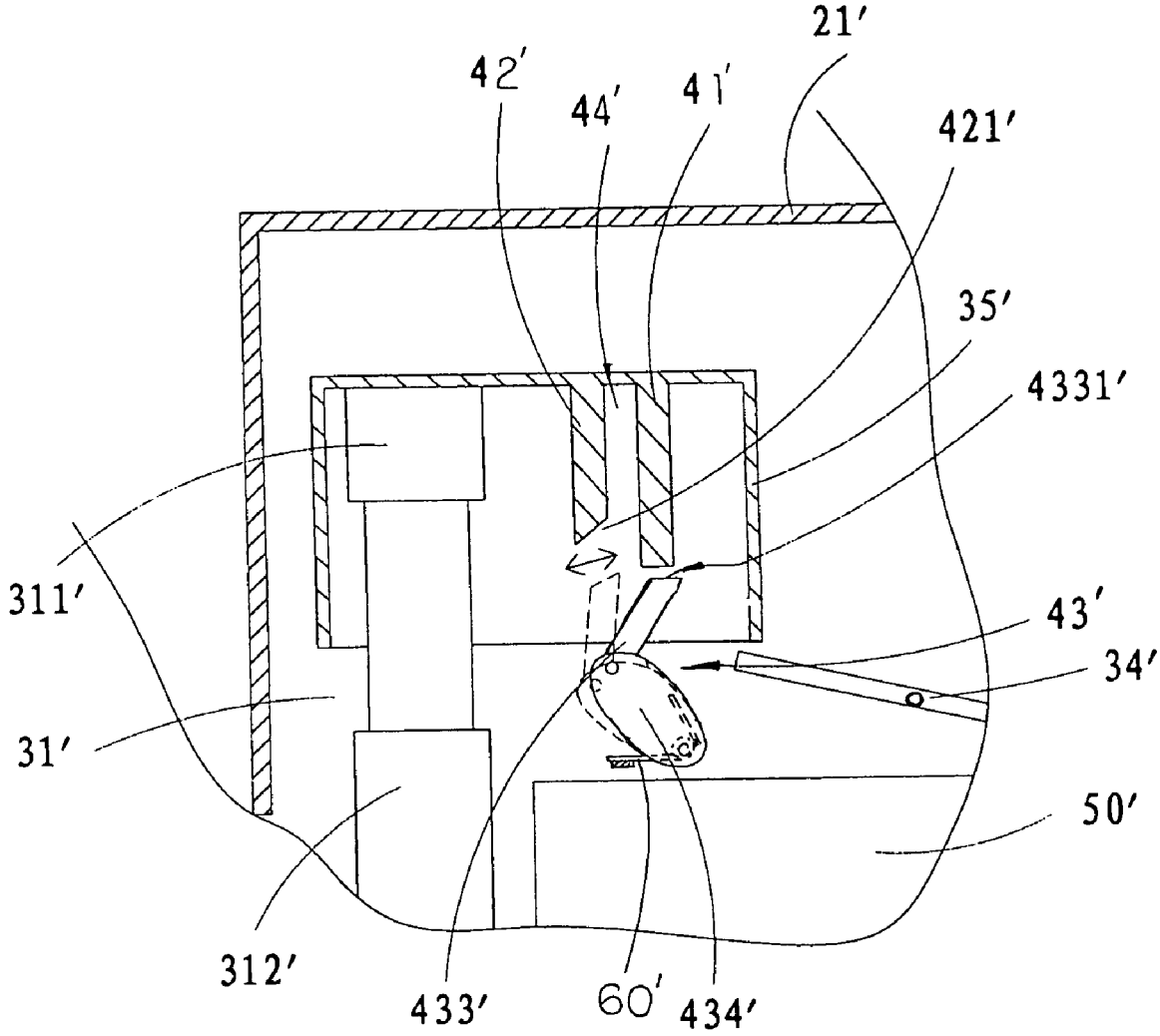
FIG. 5 is a partially sectional schematic view of the safety arrangement of the utility lighter according to the above second preferred embodiment of the present invention.

Referring to FIGS. 4 and 5 of the drawings, a utility lighter 10' incorporated with a safety arrangement according to a second preferred embodiment of the present invention is illustrated. According to the second embodiment of the present invention, the locking member 43' of the safety arrangement 40' is modified to be rotatably mounted in the lighter housing 21 right below the pusher button 35' and is adapted for rotatably switching between a locked position and an unlocked position of an arc-shaped safety slot 37'.

The locking member 43' comprises a driver member 434' having a bottom pivot end pivotally supported in the lighter housing 21, and an outer switching member 431' connected to a top switch end of the driver member 434' and extended outside the lighter housing 21 through the safety slot 37' for switching operation by a user, and a stopper 433' integrally and upwardly extended from the top switch end of the driver member 434' to normally positioned right below the stop post 41' of the pusher button 35'. The safety arrangement 40' further comprises a resilient element 60' for retaining the locking member 43' in a locked position normally, wherein the stopper 433' is arranged to bias against the stop post 41' of the pusher button 35' when the locking member 43' is in the locked position as shown in FIG. 5A. Furthermore, the stopper 433' has an inclined biasing surface 4331' at its top end with respect to horizontal. Note that the safety slot 37' is curved in shape so as to suit the pivotal movement of the locking member 43'. According to the second preferred embodiment of the present invention, the resilient element 60' is a coil spring.

When the locking member 43' is in normal locked position, the locking member 43' is retained to have the inclined biasing surface 4331 ' of the stopper 433' right below the bottom end of the stop post 41', as shown in FIG. 5, so as to block any downward movement of the pusher button 35'. Therefore, when a user tries to depress the pusher button 35' downwardly, the stop post 41' will bias against the stopper 433' and thus the downward motion of the pusher button 35' is blocked. The user cannot depress the pusher button 35' anymore and the lighter is locked.

When the locking member 43' is switched to the unlocked position by moving the switching member 431', the locking member 43' is so pivoted until the inclined surface 4331' of the stopper 433' is positioned below the tapered guiding end of the guider latch 42' and adapted to fittedly bias against the slanted surface 421' of the guider latch 42'. When a user depresses the pusher button 35' downwardly, the stop post 41' will slightly push aside the stopper 433' of the locking member 43' that diverts the stopper 433' to slide into the guiding slot 44'. Then, the pusher button 35' can now be depressed freely to ignite the utility lighter 10' without any blocking from the locking member 43'.

To ignite the utility lighter 10', a user has to switch the locking member 43' from the locked position to unlocked position of the safety slot 37'. Then, the user can depress the pusher button 35' to ignite the utility lighter 10'. After the ignition, when the user relieves both the pusher button 35' and the locking member 43', the resilient element 60' can drive the locking member 43' to return to its original locked position and the pusher button 35' is rebounded back to its original position by the piezoelectric unit 31', so as to automatically render the utility lighter 10' in the locked state after use.

Figure 6:
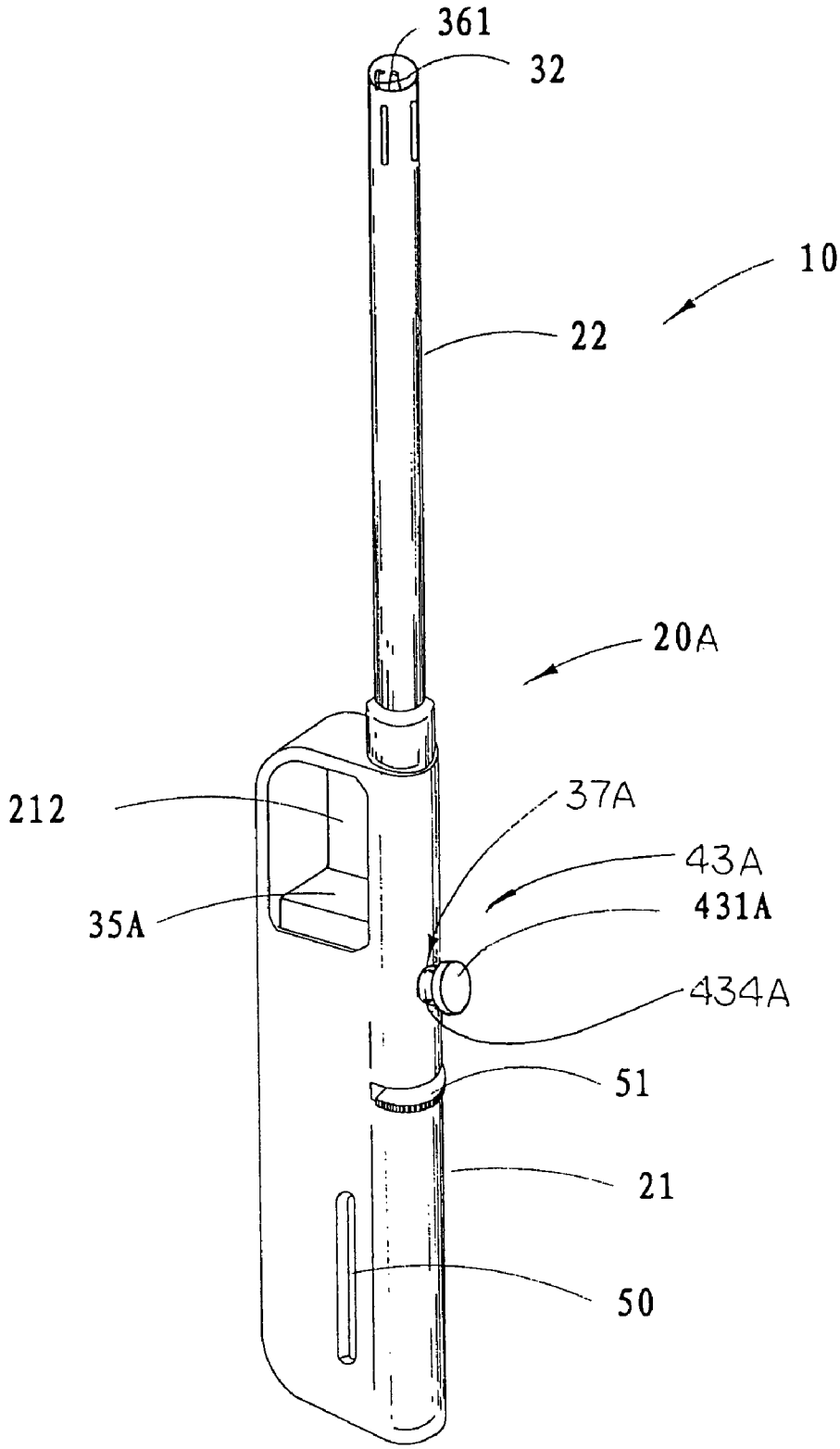
FIG. 6 is a perspective view of the utility lighter incorporated with a safety arrangement according to a third preferred embodiment of the present invention.
Figure 7:
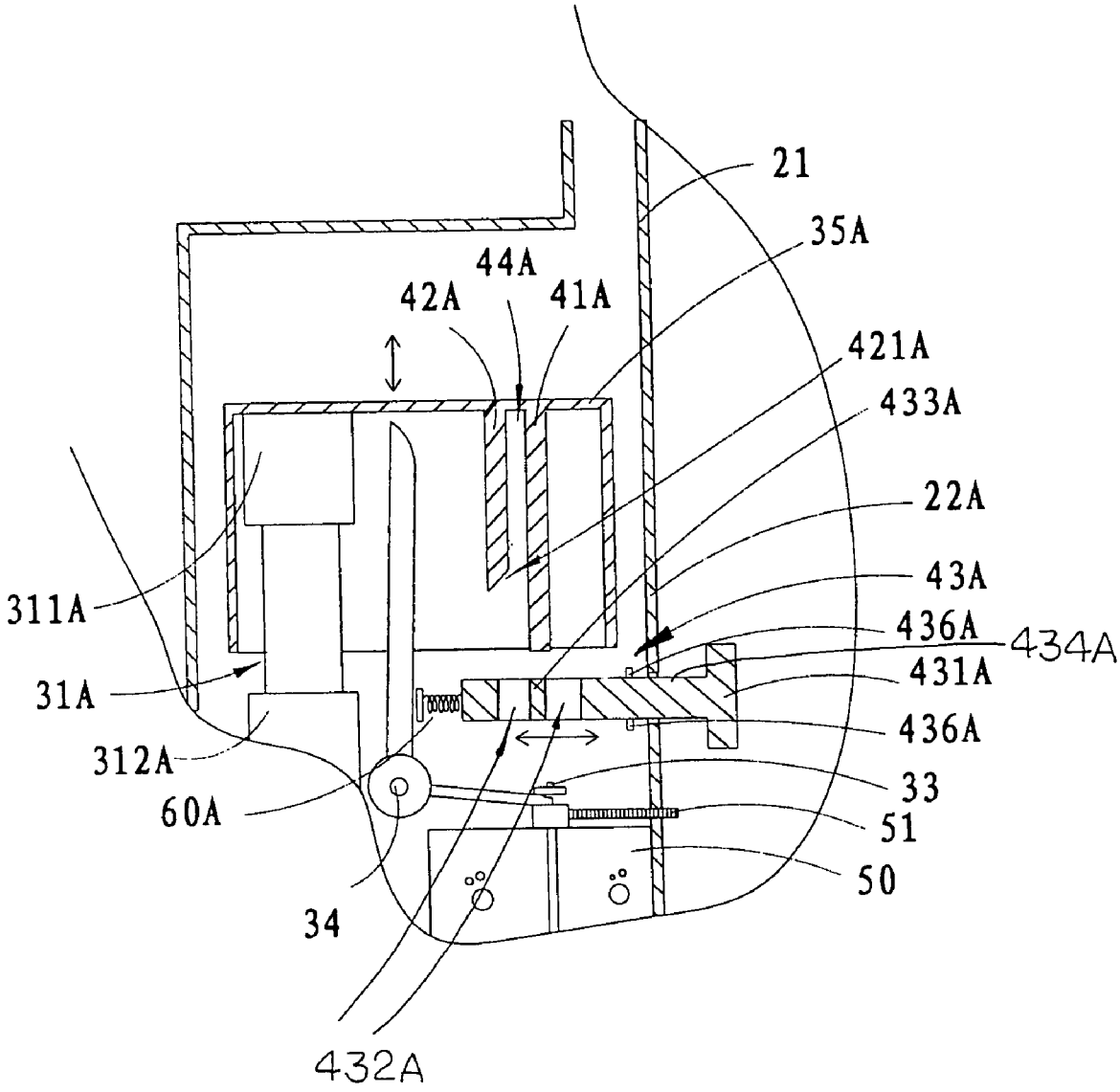
FIG. 7 is a partially sectional schematic view of the safety arrangement of the utility lighter according to the above third preferred embodiment of the present invention.

Referring to FIGS. 6 and 7 of the drawings, a utility lighter 10A incorporated with a safety arrangement according to a third preferred embodiment of the present invention is illustrated, wherein the locking member 43A and the safety slot 37A of the ignition system 30A are alternatively modified. According to the third preferred embodiment of the present invention, the locking member 43A comprises a driver member 434A which is connecting arm transversely and slidably mounted in the lighter housing 21 with respect to the lighter housing 1, a switching member 431A connected to an outer end of the driver member 434A and extended outside the lighter housing 21 through a safety slot 37A formed at a side position of the lighter housing 21, a stopper 433A longitudinally extended, with respect to the lighter housing 21, from an inner end of the driver member 434A to position right below the stop post 41A adapted for biasing against the stop post 41A in the locking cavity 351A when the locking member 43A is in the locked position, as shown in FIG. 7 of the drawings. Two sliding cavities 432A are formed at two sides of the stopper 433A.

When the locking member 43A is in the locked position, the stopper 433A is positioned right below the stop post 41A in the locking cavity 351A. When a user tries to depress the pusher button 35A, the stop post 41A will bias against the stopper 433A of the locking member 43A, and as a result, the downward movement of the pusher button 35A is blocked by the stopper 433A and the utility lighter 10A is locked.

By pushing down the switching member 431A, the locking member 43A is driven to the unlocked position that the top end of the stopper 433A of the locking member 43A is pushed to move to a position right below the slanted surface 421A of the tapered guiding end of the guider latch 42A. In this condition, when a user depresses the pusher button 35A downward gradually, the slanted surface 421A will slightly push the locking member 43A aside and the stopper 433A will slide into the guiding slot 44A. In other words, the stop post 41A and the guider latch 42A will be depressed into the two sliding cavities 432A of the locking member 43A.

According to the third embodiment of the present invention, a distance formed between the tapered guiding end of the guider latch 42A and the bottom end of the stop post 41A is preferred to be slightly larger than the thickness of the outer switching member 431A of the locking member 43A, so that when the outer switching member 431A is completely pressed into the lighter housing 21A, the top side edge 434A of the stopper 433A is positioned right below the slanted surface 421A.

In order to ignite the utility lighter 10A a user has to press the outer switching member 431A to the unlocked position and, at the same time, to depress the pusher button 35A to ignite the utility lighter 10A. After the ignition, the resilient element 60A will rebound the locking member 43A to its original position and the piezoelectric unit 31A will rebound the pusher button 35 to its original undepressed position. Moreover, the locking member 43A further has a ring-shaped stopping rib 436A formed around the driver member 434A for stopping the outward motion of the locking member 43A which is resulted by the urging force exerted by the resilient element 60A to the locking member 43A. Whereby, the stopper 433A of the locking member 43A is always aligned with the stop post 41A in the locking cavity 351A. Note that the resilient element 60A used in the third preferred embodiment is a regular compressive spring.

Figure 8:
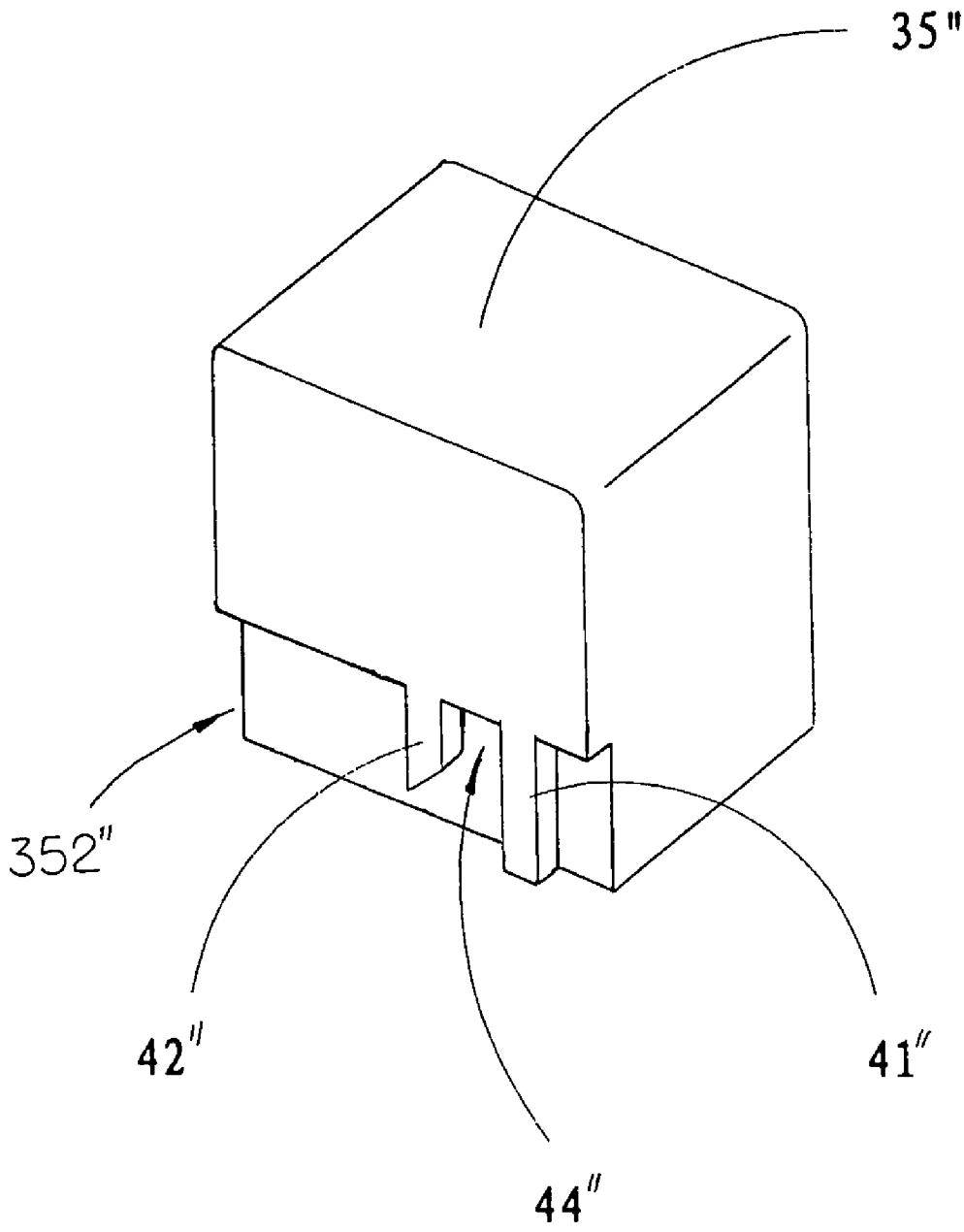
FIG. 8 is a perspective view of an alternative mode of the pusher button of the utility lighter according to the above first, second, and third preferred embodiment of the present invention.

As shown in FIG. 8, an alternative mode of the pusher button 35" is illustrated, which is alternatively modified from that of the above first, second, and third embodiments, wherein the stop post 41" and the guider latch 42" are spacedly protruded from a bottom portion 352" of a side surface of the pusher button 35". Correspondingly, the locking member 43" is preferred to be slidably supported adjacent to a side wall of the lighter housing 21 and positioned right below the stop post 41" and the guider latch 42".

Figure 9:
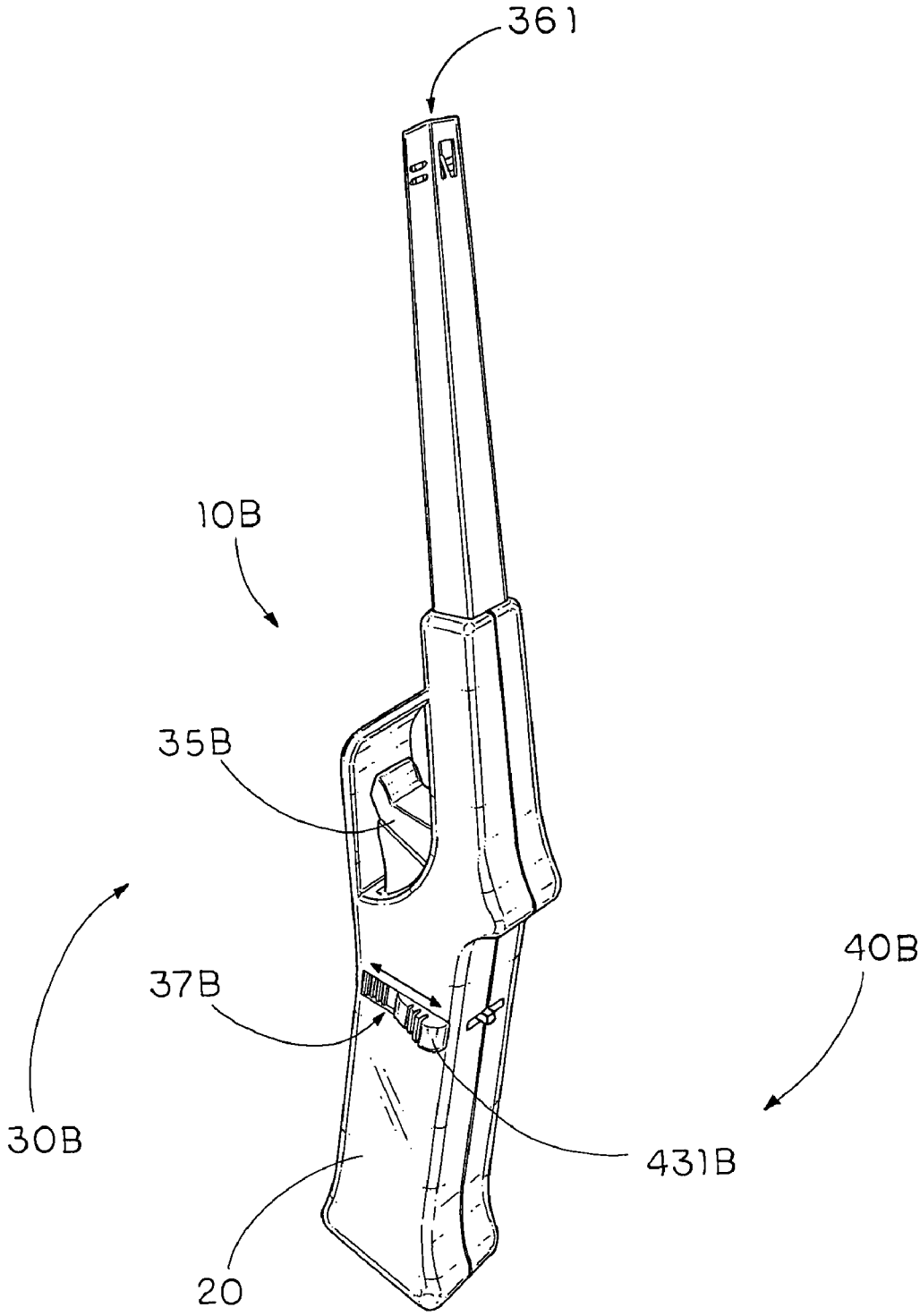
FIG. 9 is a perspective view of a utility lighter incorporated with a safety arrangement according to a fourth preferred embodiment of the present invention.
Figure 10:
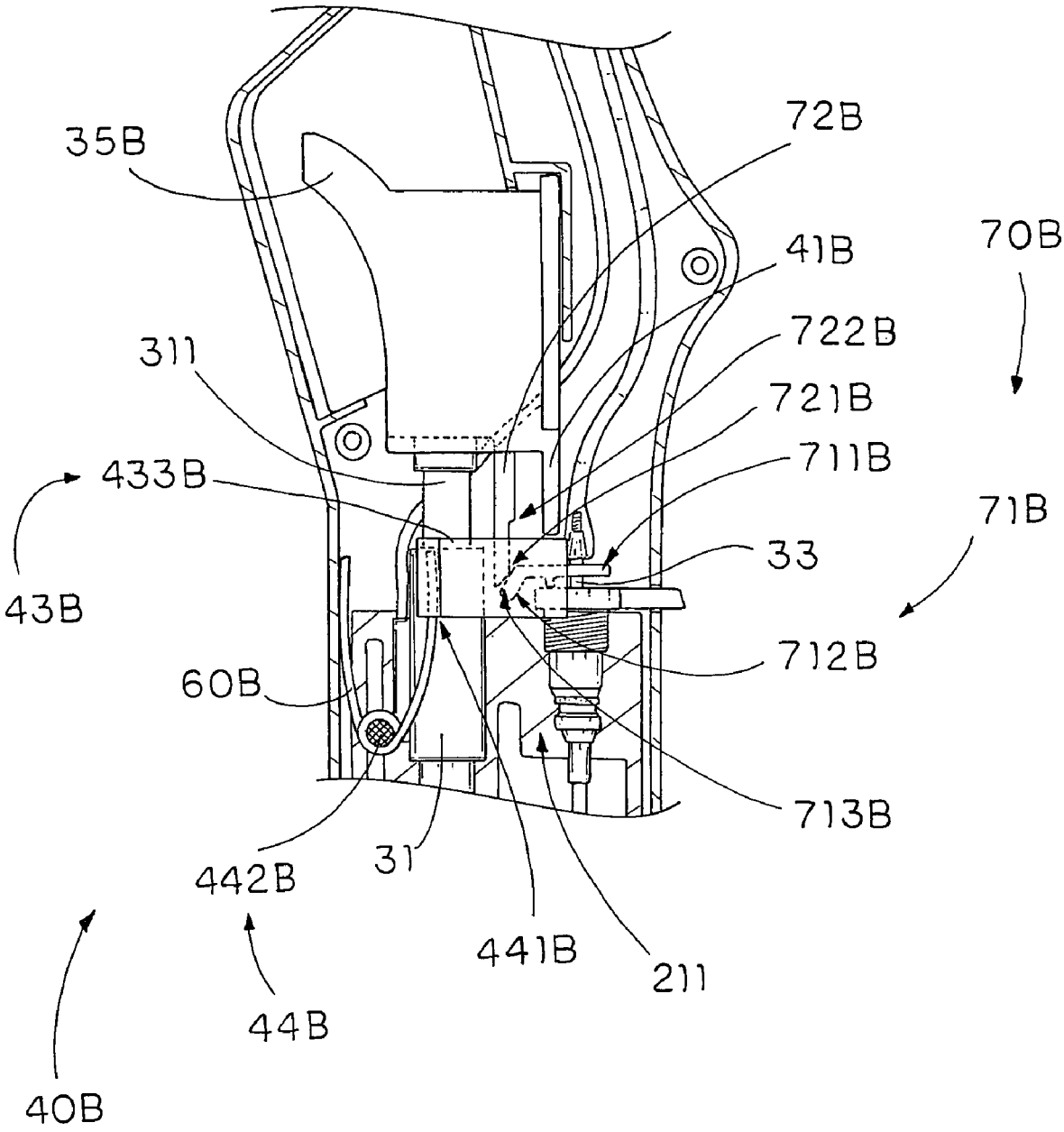
FIG. 10 is a sectional view of the safety arrangement of the utility lighter at a locked position according to the fourth above preferred embodiment of the present invention.

Referring to FIGS. 9 and 10, a utility lighter 10B according to a fourth embodiment illustrates an alternative mode of the first embodiment of the present invention. According to the fourth embodiment of the present invention, the safety arrangement 40B is alternatively modified.

The safety arrangement 40B comprises a stop post 41B extended from the pusher button 35B, a locking member 43B supported by the lighter housing 21, and a resilient element 60B supported in the internal cavity 211 of the lighter housing 21.

Figure 11:
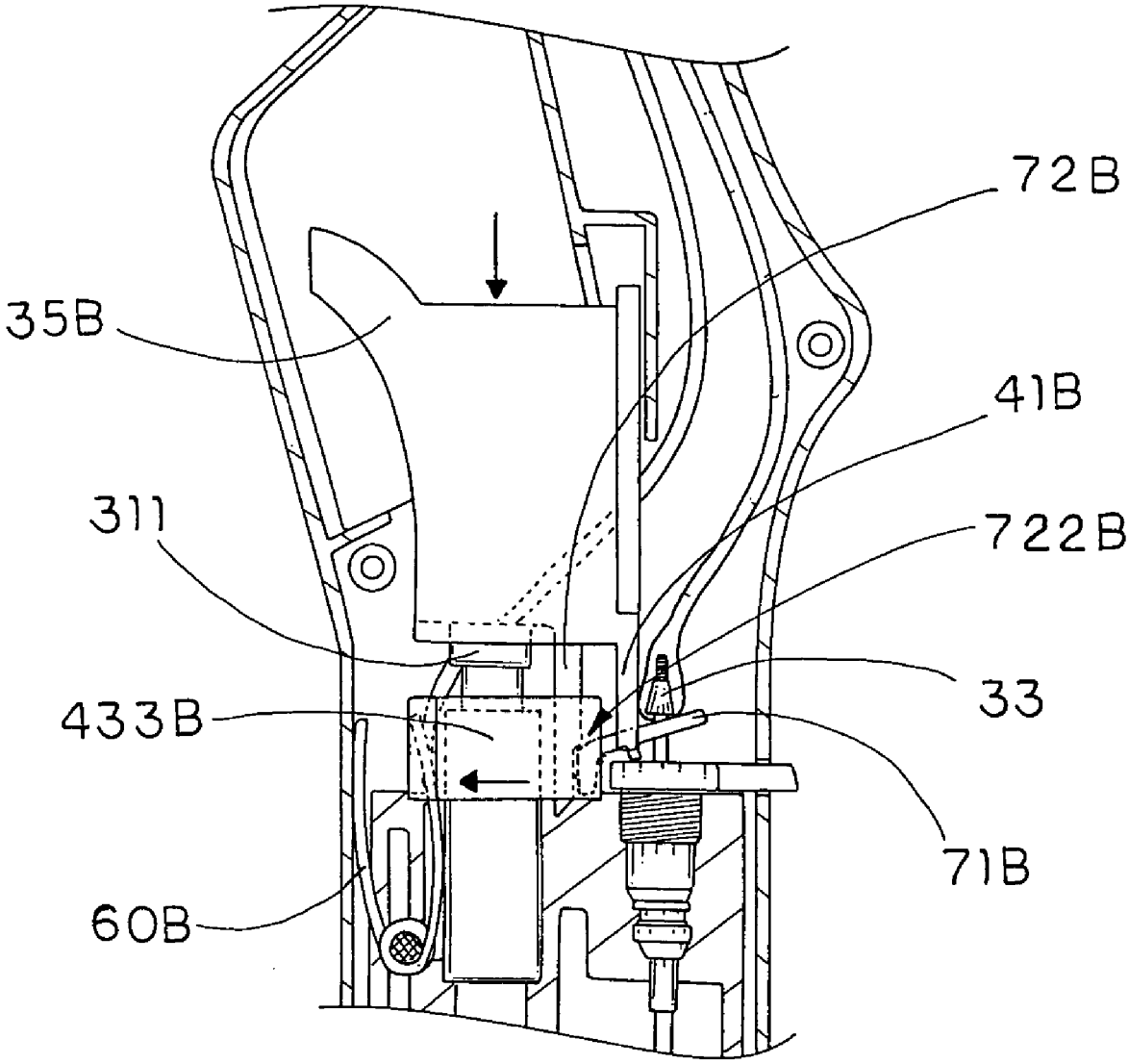
FIG. 11 is a sectional view of the safety arrangement of the utility lighter at an unlocked position according to the above fourth preferred embodiment of the present invention.

The locking member 43B comprises a switching member 431B slidably mounted on an outer wall of the casing 20 along the safety slot 37B and a stopper 433B extended from the switching member 431B to the internal cavity 211 through the safety slot 37B to align with the stop post 41B. Accordingly, the switching member 431B is arranged to slidably drive the stopper 433B between a locked position and an unlocked position. In which, at the locked position, as shown in FIG. 10, the stop post 41B is blocked by the stopper 433B so as to block a downward movement of the pusher button 35B for ignition. At the unlocked position, as shown in FIG. 11, the switch member 431B is arranged to drive the stopper 433B to move to an offset position that allows the pusher button 35B to be depressed so as to depress the movable part 311 of the piezoelectric unit 31 for igniting the utility lighter 10B.

The resilient element 60B is supported in the internal cavity 211 of the lighter housing 21 for urging a pushing force to the locking member 43B to normally retain the locking member 43B at the locked position.

According to the fourth preferred embodiment, the utility lighter 10B further comprises a gas releasing unit 70B for control a flow of liquefied fuel, wherein the gas releasing unit 70B comprises a gas lever 71B having a pivot end 711B engaged with the gas emitting nozzle 33 and an actuating end 712B arranged to be depressed so as to pivotally lift up the gas emitting nozzle 33 for releasing the liquefied fuel, and a gas actuating arm 72B downwardly extended from the pusher button 35B towards the actuating end 712B of the gas lever 71B such that when the pusher button 35B is depressed, the actuating arm 72B is driven to depress the actuating end 712B of the gas lever 71B for releasing the liquefied fuel so as to ignite the liquefied fuel at the ignition tip 361.

As shown in FIG. 10, the gas actuating arm 72B has a driving shoulder 722B provided between a bottom end of the gas actuating arm 72B and a bottom side of the pusher button 35B to substantially engage with the actuating end 712B of the gas lever 71B so as to pivotally lift up the pivot end 711B thereof when the pusher button 35B is depressed downwardly. In other words, when the pusher button 35B is depressed downwardly, the gas actuating arm 72B is driven downwardly until the driving shoulder 722B is engaged with the actuating end 712B of the gas lever 71B to depress the actuating end 712B of the gas lever 71B so as to ensure the liquefied fuel releasing from the fuel storage housing 50 when the pusher button 35B is depressed. Therefore, the user must intentionally depress the pusher button 35B until the driving shoulder 722B reaches the actuating end 712B of the gas lever 71B for releasing the liquefied fuel, so as to prevent the unintentional ignition of the utility lighter 10B.

The gas lever 71B has a slanted engaging surface 713B formed on the actuating end 712B and the gas actuating arm 72B has a corresponding slanted driving surface 721B formed at the bottom end to slidably engage with the slanted engaging surface 713B of the gas lever 71B so as to substantially guide the gas actuating arm 72B to slide along the slanted engaging surface 713B of the gas lever 71B until the driving shoulder 722B of the gas actuating arm 72B is engaged with the actuating end 712B of the gas lever 71B. In other words, the slanted engaging surface 713B of the gas lever 71B and the slanted driving surface 721B of the gas actuating arm 72B substantially enhance the contacting surface between the gas lever 71B and the gas actuating arm 72B so as to ensure the sliding movement of the gas actuating arm 72B with respect to the gas lever 71B.

As shown in FIG. 10, the stop post 41B is integrally and downwardly extended from the pusher button 35B wherein a bottom end of the stop post 41B is extended towards the stopper 433B so as to block up the downward movement of the pusher button 35B.

The safety slot 37B is transversely formed on a sidewall of the lighter housing 21B to guide the locking member 43B in a sideward movable manner, wherein the safety slot 37B has a predetermined length adapted for the switching member 431B to drive the stopper from the locked position to the unlocked position. It is worth to mention that the locking member 43B is slidably mounted on the sidewall of the lighter housing 21 along the safety slot 37B such that when the user holds the utility lighter of the present invention, the size of the user's hand is big enough that the user's finger is able to trigger the pusher button 35B while the user's thumb is able to easily reach the locking member 43B on the respective sidewall of the lighter housing 21 so as to enhance the unlocking operation of the safety arrangement 40B for igniting the utility lighter 10B.

The stopper 433B is integrally extended from the switching member 431B to the internal cavity 211 through the safety slot 37B such that the switching member 431B is driven to slide on the outer wall of the casing 20 along the safety slot 37B to drive the stopper 433B from the locked position to the unlocked position.

The switching member 431B is driven to slide sidewardly along the safety slot 37B, the stopper 433B is moved offset from the bottom end of the stop post 41B, as shown in FIG. 11, such that the pusher button 35B is adapted to be depressed to depress the movable part 311 of the piezoelectric unit 31 and release the liquefied fuel via the gas releasing unit 70B so as to ignite the utility lighter 10B of the present invention.

The resilient element 60B, according to the preferred embodiment of the present invention, is a coil spring which is disposed in the internal cavity 211 and is provided between the locking member 43B and an inner wall of the internal cavity 211. The resilient element 60B has two end portions biasing against the stopper 433B of the locking member 43B and the inner wall of the internal cavity 211. Accordingly the resilient element 60B normally urge and retain the stopper 433B to align with the stop post 41B to block up the pusher button 35B from being slid downwardly so as to lock up the pusher button 35B from ignition.

The safety arrangement 40B further comprises a holding unit 44B for holding the resilient element 60B in the internal cavity 211B so as to secure the two end portion of the resilient element 60B to bias against the locking member 43B and the inner wall of the internal cavity 211. As shown in FIG. 10, the holding unit 44B has a retaining groove 441B formed on the stopper 433B and comprises a coil holder 442B integrally extended from the sidewall of the internal cavity 211 wherein the respective end portion of the resilient element 60B is fittingly engaged with the retaining groove 441B while a coil body of the resilient element 60B is securely mounted to the coil holder 442B so as to securely hold the resilient element 60B in the internal cavity 211 to bias against the locking member 43B.

It is worth to mention that when the respective end portion of the resilient element 60B is engaged with the retaining groove 441B, the end portion of the resilient element 60B is arranged to not only bias against the stopper 433B to retain the locking member 43B at the locked position but also lock up the locking member 43B on the lighter housing 21 so as to reinforce the switching member 431B to slide on the sidewall of the lighter housing 21 along the safety slot 37B. In other words, the coil spring of the resilient element 43B has two particular functions for retaining the locking member 431B at the locked position and for locking the locking member 431B with the lighter housing 21.

In order to ignite the utility lighter 10B a user has to slide the switching member 431B to the unlocked position and, at the same time, to depress the pusher button 35B to ignite the utility lighter 10B. After the ignition, the resilient element 60B will rebound the locking member 43B to its original position and the piezoelectric unit 31 will rebound the pusher button 35B to its original undepressed position. Therefore, the stopper 433B of the locking member 43B is always aligned with the stop post 41B after every ignition.

In view of the above first, second, third, and fourth embodiments, the utility lighter of the present invention substantially achieves the following distinctive features and advantages:

(1) The utility lighter is capable of automatically locking the lighter of the present invention from being accidentally ignited after every use and when it is idle or not in use.

(2) The utility lighter can only be ignited by two simultaneous actions of a user, i.e. an action of unlocking the safety arrangement and an action of ignition of the lighter.

(3) The utility lighter does not significantly alter the original structure and shape of conventional lighters, so as to minimize the manufacturing cost of the lighter of the present invention.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A utility lighter, comprising:

a casing having a lighter housing, which has an internal cavity and a pusher cavity therein, and a tubular lighter rod extended from said lighter housing, wherein said lighter housing further has a safety slot provided on a sidewall of said lighter housing to communicate said internal cavity with an exterior of said lighter housing;

a fuel storage housing disposed in said internal cavity of said lighter housing for storing liquefied gaseous fuel;

an ignition system which comprises:

a gas emitting nozzle communicated with said fuel storage housing for releasing gaseous fuel;

a gas tube extended from said gas emitting nozzle to a top end portion of said lighter rod to form an ignition tip therein;

a piezoelectric unit supported in said internal cavity for generating piezoelectricity, wherein said piezoelectric unit comprises a movable part and a spark generating tip extended to said ignition tip through said lighter rod for generating sparks when said movable part of said piezoelectric unit is depressed; and a pusher button which is supported in said pusher cavity in a slidably movable manner to drive said movable part of said piezoelectric unit to be depressed;

a gas releasing unit for control a flow of said liquefied fuel, wherein said gas releasing unit comprises a gas lever having a pivot end engaged with said gas emitting nozzle and an actuating end arranged to be depressed to pivotally lift up said gas emitting nozzle for releasing said liquefied fuel, and an elongated gas actuating arm integrally extended from a bottom side of said pusher button towards said actuating end of said gas lever at a position that a bottom end of said gas actuating arm is coupled with said actuating end of said gas lever, wherein said gas actuating arm has a driving shoulder protruding therefrom at a position between said bottom end of said gas actuating arm and said bottom side of said pusher button, wherein when said pusher button is depressed, said gas actuating arm slides at said actuating end of said gas lever until said driving shoulder of said gas actuating arm substantially biases against said actuating end of said gas lever to depress said actuating end of said gas lever so as to pivotally lift up said pivot end thereof for releasing said liquefied fuel so as to ignite said liquefied fuel at said ignition tip; and a safety arrangement, which comprises:

an elongated stop post integrally and downwardly extended from said bottom side of said pusher button at a position parallel to said gas actuating arm;

a locking member, which comprises a switching member slidably mounted on said sidewall of said casing along said safety slot and a stopper which is integrally extended from said switching member into said lighter housing through said safety slot at a position below said pusher button to normally block up said pusher button sliding towards said piezoelectric unit, wherein said safety slot is transversely provided on said sidewall of said lighter housing, wherein said switching member is slid on said sidewall of said lighter housing along said safety slot to drive said stopper between a locked position and an unlocked position, wherein at said locked position, said stop post is positioned right above said stopper such that said pusher button is blocked to depress said piezoelectric unit for ignition, and at said unlocked position, said switch member is slid on said sidewall of said light housing along said safety slot to drive said stopper to move aside from said stop post that allows said pusher button to be depressed to depress said movable part of said piezoelectric unit and to depress said actuating end of said gas lever simultaneously for igniting said utility lighter; and a resilient element supported in said internal cavity of said lighter housing for urging a pushing force to said locking member to normally retain said locking member at said locked position, wherein said resilient element comprises a coil spring which is disposed in said internal cavity and is provided between said locking member and an inner wall of said internal cavity, wherein said resilient element has two end portions biasing against said stopper of said locking member and said inner wall of said internal cavity to urge and retain said stopper to align with said stop post to block up said pusher button from being slid towards said piezoelectric unit such that said switching member must be retained at said unlocked position in order to depress said pusher button for igniting said utility lighter while said resilient element pushes said switching member back to said locked position for re-locking said utility lighter after said ignition of said utility lighter is completed.

2. The utility lighter, as recited in claim 1, wherein said safety arrangement further comprises a holding unit which has a retaining groove formed on said stopper and comprises a coil holder integrally extended from said sidewall of said internal cavity, wherein said respective end portion of said resilient element is fittingly engaged with said retaining groove to slidably engage with said locking member while a coil body of said resilient element is securely mounted to said coil holder to secure said two end portions of said resilient element to bias against said locking member and said inner wall of said internal cavity respectively.

3. The utility lighter, as recited in claim 1, wherein said gas lever has a slanted engaging surface formed on said actuating end and said gas actuating arm has a corresponding slanted driving surface formed at said bottom end to slidably engage with said slanted engaging surface of said gas lever so as to substantially guide said gas actuating arm to slide along said slanted engaging surface of said gas lever until said driving shoulder of said gas actuating arm is engaged with said actuating end of said gas lever.

4. The utility lighter, as recited in claim 2, wherein said gas lever has a slanted engaging surface formed on said actuating end and said gas actuating arm has a corresponding slanted driving surface formed at said bottom end to slidably engage with said slanted engaging surface of said gas lever so as to substantially guide said gas actuating arm to slide along said slanted engaging surface of said gas lever until said driving shoulder of said gas actuating arm is engaged with said actuating end of said gas lever.

* * * * *